US008973901B2

(12) United States Patent
Roodenburg et al.

(10) Patent No.: US 8,973,901 B2
(45) Date of Patent: Mar. 10, 2015

(54) DOUBLE DRUM TRACTION WINCH

(75) Inventors: Joop Roodenburg, Delft (NL); Joost Sanderse, Nieuwerkerk Aan de Ijssel (NL)

(73) Assignee: ITREC B.V., Schiedam (NL)

( * ) Notice: Subject to any disclaimer, the term of this patent is extended or adjusted under 35 U.S.C. 154(b) by 158 days.

(21) Appl. No.: 13/704,177

(22) PCT Filed: Jun. 16, 2011

(86) PCT No.: PCT/NL2011/050436
§ 371 (c)(1),
(2), (4) Date: Mar. 5, 2013

(87) PCT Pub. No.: WO2011/159159
PCT Pub. Date: Dec. 22, 2011

(65) Prior Publication Data
US 2013/0170939 A1 Jul. 4, 2013

(30) Foreign Application Priority Data
Jun. 17, 2010 (NL) ..... 2004908

(51) Int. Cl.
*B66D 1/14* (2006.01)
*B66D 1/74* (2006.01)
*B66D 1/26* (2006.01)
*B66D 1/76* (2006.01)

(52) U.S. Cl.
CPC ..... *B66D 1/7405* (2013.01); *B66D 1/26* (2013.01); *B66D 1/741* (2013.01); *B66D 1/76* (2013.01)
USPC ..... 254/293; 254/278; 254/290

(58) Field of Classification Search
CPC ..... B66D 1/26; B66D 1/36; B66D 1/7405; B66D 1/741; B66D 1/76
USPC ..... 254/278, 279, 287, 290, 293, 294
See application file for complete search history.

(56) References Cited

U.S. PATENT DOCUMENTS

| | | | | |
|---|---|---|---|---|
| 3,966,170 | A * | 6/1976 | McKenna | 254/280 |
| 4,204,664 | A * | 5/1980 | Bryan, Jr. | 254/288 |
| 6,089,547 | A * | 7/2000 | Juelich et al. | 254/329 |
| 7,798,471 | B2 * | 9/2010 | Christopher | 254/277 |
| 8,684,336 | B1 * | 4/2014 | Akerman | 254/337 |

(Continued)

FOREIGN PATENT DOCUMENTS

| | | |
|---|---|---|
| DE | 931 315 | 8/1955 |
| FR | 1 105 165 A | 11/1955 |

(Continued)

*Primary Examiner* — Emmanuel M Marcelo
(74) *Attorney, Agent, or Firm* — Birch, Stewart, Kolasch & Birch, LLP

(57) ABSTRACT

A double drum traction winch supporting a first and second rotatable drum is provided. The circumferential surface of each drum is provided with circumferential grooves perpendicular to the rotational axis of the drum. The grooves of each drum are subdivided in a first set of grooves for guiding a first wire and a second set of grooves for guiding a second wire. The grooves of the first set alternate with grooves of the second set such that the circumferential surface of each drum is provided with multiple grooves of the first group, each interpositioned between two grooves of the second group. Therefore the traction winch is capable of cooperating with a first wire in the first set of grooves or with a second wire in the second set of grooves, wherein both wires differ in type of material and/or cross section and/or maximum tensile strength.

12 Claims, 4 Drawing Sheets

(56) References Cited

U.S. PATENT DOCUMENTS

| | | | | |
|---|---|---|---|---|
| 2011/0278520 | A1* | 11/2011 | Ingeberg | 254/281 |
| 2013/0020544 | A1* | 1/2013 | Lawson et al. | 254/287 |
| 2014/0199152 | A1* | 7/2014 | Roodenburg et al. | 414/800 |

FOREIGN PATENT DOCUMENTS

| | | | | |
|---|---|---|---|---|
| GB | 2 009 077 | A | 6/1979 | |
| WO | 00/10903 | A1 | 3/2000 | |
| WO | WO 2012/144900 | A1 * | 10/2012 | 254/278 |

* cited by examiner

DOUBLE DRUM TRACTION WINCH

The present invention relates to a double drum traction winch according to the preamble of claim 1 and to a method for using such a traction winch according to claim 12.

Double drum traction winches are known in the art, and typically comprise a frame supporting a first and second rotatable drum such that a wire can be wound about the two drums, and further comprising one or more drives for rotating both drums about their respective rotational axis. The circumferential surface of each drum is provided with parallel circumferential grooves extending perpendicular to the rotational axis of the drum, for engaging a wire which is wound about both drums. The rotational axis of the first drum is tilted relative to the rotational axis of the second drum such that a circumferential groove of the second drum guides a wire wound about both drums from a first circumferential groove on the first drum to a second circumferential groove on the first drum.

Traction winches are used for taking in and letting out elongated bodies such as cables, wires, umbilicals, or the like. In particularly, the invention relates to winches intended to haul very heavy loads and/or loads at great depths by means of a cable. In these situations a not inconsiderable part of the load is often constituted by the weight of the cable, generally a cable of large diameter and of very great length. The invention furthermore relates to vessel mounted winches, and the application of such a winch to off-shore technologies, e.g. for abandonment and recovery applications, oceanography, dredging at great depths, or to towing of large floating loads by tow boats.

A problem of known traction winches is that they are suited for use with a limited range of wires only. The drums are provided with parallel grooves in their circumferential surface for engaging and guiding a wire. These grooves are adapted for cooperation with a specific type of wire. The dimensions of the groove, for example the width or the shape of the cross section, are designed such that the groove optimally engages a specific type of wire, that is a wire made of a specific type of material, having a specific outer surface, shape or tensile strength. The winch is thus suited for use with wires of an essentially similar cross section, type of material and tension strength.

To allow use of the traction winch for a wide range of loads, in practice a winch is provided which is capable of lifting heavy loads, and thus is capable of cooperating with a wire for lifting heavy loads. This winch and wire combination is used for lifting heavy as well as light loads.

Wires capable of lifting heavy loads in general have a large cross section. Using a wire causes wear of the wire, even when a thick wire is used for lifting light loads only the wire quality will deteriorate. When heavy duty wires are used for lifting small loads also, this will reduce the economic lifetime of the wire. Since wires having a large cross section are much more expensive than wires with a smaller cross section, using the same traction winch for lifting light loads as well as heavy loads is a costly solution, in particular when only a small percentage of the loads requires a heavy duty wire.

In another solution vessels are provided with replaceable winches. For lifting ordinary loads, a first traction winch is provided. When an extra heavy load needs to be lifted, the first winch is replaced with a heavy duty traction winch, i.e. a winch capable of cooperating with heavy duty wires is installed. After handling the heavy load, the second winch is replaced with the first winch. Thus, the more expensive heavy duty wire is only used for lifting heavy loads, and the wear of these wires is limited. However, replacing of a winch requires much time and effort. Furthermore, on off shore vessels the deck space is limited and carrying an extra winch reduces the amount of payload to be carried by the vessel.

It is an object of the invention to reduce the problems described herein above and in particular to provide yet an alternative traction winch which is cheaper in use.

According to the present invention, this object is achieved by providing a double drum traction winch according to claim one. Such a winch is characterized in that the parallel circumferential grooves of each drum are subdivided in a first set of multiple narrow grooves designed for guiding a first wire and a second set of multiple wide grooves designed for guiding a second wire. The grooves of the first set alternate with grooves of the second set such that the circumferential surface of each drum is provided with multiple grooves of the first group which are each interpositioned between two grooves of the second group, such that the traction winch is designed for cooperating with a first wire in the first set of grooves or with a second wire in the second set of grooves. The first wire differs from the second wire in type of material and/or cross section and/or maximum tensile strength.

Thus, a double drum traction winch can be designed for use with two types of wires, and thus allows for a more flexible deployment of the traction winch. For example, the traction winch can be provided with one set of grooves for cooperating with a synthetic wire and with one set of grooves for cooperating with a steel wire, or with one set of grooves for cooperating with a heavy duty wire and with one set of grooves for cooperating with a wire for lifting small loads. The double drum traction winch allows thus for switching wires, and for using the type of wire most suitable for the specific job to be done.

Since the same traction winch can be used with two types of wires, it thus allows for a more efficient use of the wires and deck space.

In a preferred embodiment of a traction winch according to the invention, the angle between the rotational axis of the first drum and the rotational axis of the second drum is such that the second drum guides a wire which is wound about both drums in a direction parallel to the rotational-axis of the first drum over a distance which is essentially twice the distance between the centrelines of two adjacent grooves.

When seen in top view, the rotational axes of the two drums run parallel to each other, and when seen in side view the axes are at an angle with each other. When seen in side view, one drum is pitched clock wise, and the other drum is pitched counter clockwise, such that the axes overlap and form an x. It is observed that the angle between the axes is larger than the angle between the axes of an ordinary traction winch with a single set of grooves.

By pitching the drums relative to each other the wires are fed from one groove on a first drum into a second groove on the opposite drum more ore less perpendicular to the rotational axis of that drum and thus in line with the groove. Thus the torsion in the wire, and therefore ear, is limited.

In a further preferred embodiment, the parallel circumferential grooves of the second set are wider than the parallel circumferential grooves of the first set such that the circumferential surface of each drum is provided with multiple narrow grooves which are each interpositioned inbetween two wide grooves. This enables the winch to cooperate with a first wire in the first set of grooves or with a second wire in the second set of grooves, which second wire differs form the first wire in diameter or width of its cross section.

Such a traction winch is for example provided with one set of grooves adapted for cooperating with a steel wire having a diameter of 76 mm, and a second set of grooves adapted for cooperating with a steel wire having a diameter of 121 mm. The first wire is used for lifting loads up to 150 Mt while the second wire is used for loads above 150 Mt ton and up to 450 Mt.

The winch is thus adapted for use with a first wire for lifting light loads, and for use with a second wire for lifting heavy loads. Thus, light loads do not need to be lifted with the heavy duty wire. The wear of the more expensive heavy duty wires is limited and the overall running costs are reduced. Furthermore, switching wires only requires removing the first wire from the one set of grooves and inserting the second wire in the second set of grooves. This requires much less time and manpower than replacing a first traction winch adapted for use with the first wire with a second traction winch adapted for use with the second wire.

In a double drum traction winch according to the invention, grooves of the first set alternate with grooves of the second set. Providing the narrow grooves in-between the wider grooves, the pitch between the centrelines of the grooves is large compared to the pitch of a traction winch comprising a single set of grooves. However, compared to the length of the drum on which both sets of grooves are provided one set next to the other, the minimum length of the drum required for providing both sets of grooves is reduced. This allows for a compact drum design and for a more even distribution of the load over the drums.

Furthermore, due to the compact drum design the wires are distributed more closely to the mid section of the drum, which is advantageous when the angle between the rotational axis of the first drum and the rotational axis of the second drum is such that the second drum guides a wire which is wound about both drums in a direction parallel to the rotational axis of the first drum over a distance which is essentially twice the distance between the centrelines of two adjacent grooves. In this embodiment the drums are preferably positioned such that, when seen in side view, the rotational axis overlap and form an x. Thus, the central grooves of the two drums are more or less in line with each other and the deviation between the grooves increases from the centre outwards. When the drums are compact, the deviation between the outer grooves is limited such that the wires can be guided from one groove to the other more efficiently.

In a preferred embodiment for each drum the diameter of the drum increases along the rotational axis, more in particular with each consecutive groove of the first set the diameter increases with a first factor, and with each consecutive groove of the second set the diameter of the drum increases with a second factor. The grooves of the first and second set at one end are preferably located at the same distance from the rotational axis, while at the opposite end of the drum the grooves from the first set are located at a distance to the rotational axis which differs form the distance between the grooves form the second set and the rotational axis. Due to the increase in radius of the subsequent grooves of a set, i.e. the distance between the grooves and the rotational axis of the drum the traction winch is adapted to cope with the increase in length of the first and second wire caused by elongation due to the increase of tensional load in the wire with each groove.

In a further embodiment, the grooves of the first set are provided with a first cross section, for example a V-shaped cross section, and the grooves of the second set are provided with a second cross section, for example a U-shaped cross section, of which the form differs from the shape of the first cross section. In a further embodiment, the first set of grooves is adapted for cooperating with a synthetic wire and the second set for cooperating with a steel wire. In a preferred embodiment, the grooves of the second set have a width which is at least twice the width of the grooves of the first set.

Preferably, the double drum traction winch is provided with a storage drum. The storage drum is used for providing the wire to be used on the traction winch, and for receiving the wire used. During use, the wire is guided from the storage drum, via the traction winch, to the load. Preferably, the storage drum is designed for holding a wire for cooperating with the first set of grooves and for holding a wire for cooperating with the second set of grooves, further comprising a guide system for guiding the wire stored on the storage drum to the relevant set of grooves. The storage drum is not provided with guide grooves. Therefore the one storage drum can be used for providing both the wire for cooperating with the first set of grooves and for providing a second wire for cooperating with the second set of grooves of the traction winch. The wire which is not used, is stored on a storage reel. The combination of the traction winch with a single storage drum allows for a compact design of the overall apparatus.

In an alternative embodiment, the double drum traction winch comprises a first storage drum for holding a first wire for cooperating with the first set of grooves on the traction winch and a guiding system for feeding the wire to the first set of grooves on the traction winch. The traction winch further comprises a second storage drum for holding a second wire for cooperating with the second set of grooves on the traction winch and a guiding system for feeding the second wire to the second set of grooves of the traction winch. Providing a first and second storage drum allows for a quick changing of the wire on the traction winch, since it is not necessary to replace the wire held on the storage drum also, as is the case when using a single storage drum.

In a further preferred embodiment, the two storage drums are both movable relative to the traction winch between a feeding location for feeding the wire to the traction winch and a storage location at a distance from the feeding location. This allows for a more flexible use of the deck space, since the storage locations are not directly related to the position of the traction winch. For example, depending on the other objects carried on a deck of a vessel, the storage location of the storage drum may be changed.

In a further preferred embodiment, the one feeding location is provided for use with both the first and the second storage drum. Thus, one guide system can be used for guiding the wire form the feeding location to the traction winch.

Further objects, embodiments and elaborations of the apparatus and the method according to the invention will be apparent from the following description, in which the invention is further illustrated and elucidated on the basis of a number of exemplary embodiments, with reference to the drawings.

Figure 1:
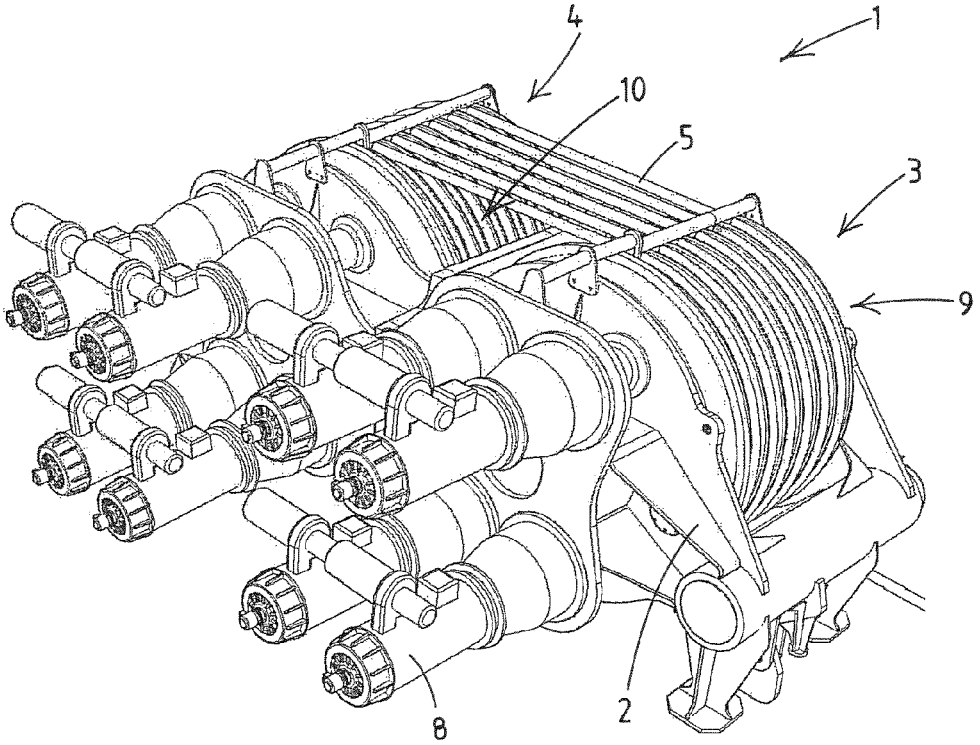
FIG. 1 shows a perspective view of a double drum traction winch according to the invention supporting a first wire.

FIG. 1 shows an exemplary embodiment of a double drum traction winch 1 according to the invention. The traction winch 1 comprises a frame 2 supporting a fist rotatable drum 3 and a second rotatable drum 4. The Rotatable drums are mounted next to each other such that a wire 5 can be wound about the two drums. Multiple drives 8 are provided for each drum for rotating the drums about their respective rotational axis.

The circumferential surface of both the first drum 3 and the second drum 4 are provided with parallel circumferential grooves 9, 10 perpendicular to the respective rotational axes 6, 7 of the respective drums 3, 4. The grooves are adapted for engaging a wire which is wound about both drums.

Figure 2:
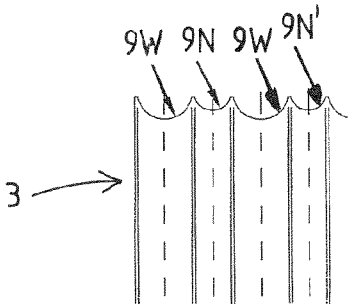
FIG. 2 shows a sectional side view of a drum of the double drum traction winch of FIG. 1.

Both drums 3, 4 are provided with a first set of multiple narrow grooves 9N, 10N and a second set of multiple wide grooves 9W, 10W. FIG. 2 shows a section of the drum 3 the alternating narrow grooves 9N and wide grooves 9W.

The grooves 9N, 10N of the first group and the grooves 9W, 10W of the second group alternate in the circumferential surface of each drum 3, 4. The grooves 9N of the first set on the first drum 3 are of similar shape and have similar dimensions as the grooves 10N of the first set on the second drum 4. The grooves of the second set are of similar shape and size also.

Thus, the winch is adapted for cooperating with a first wire in the first set of grooves and with a second wire in the second set of grooves, which second wire differs from the first wire in that it has a larger cross section. Furthermore, alternating the grooves from the first and second set enables an even distribution of the load along the drum shaft on which the drum is mounted.

Figure 4:
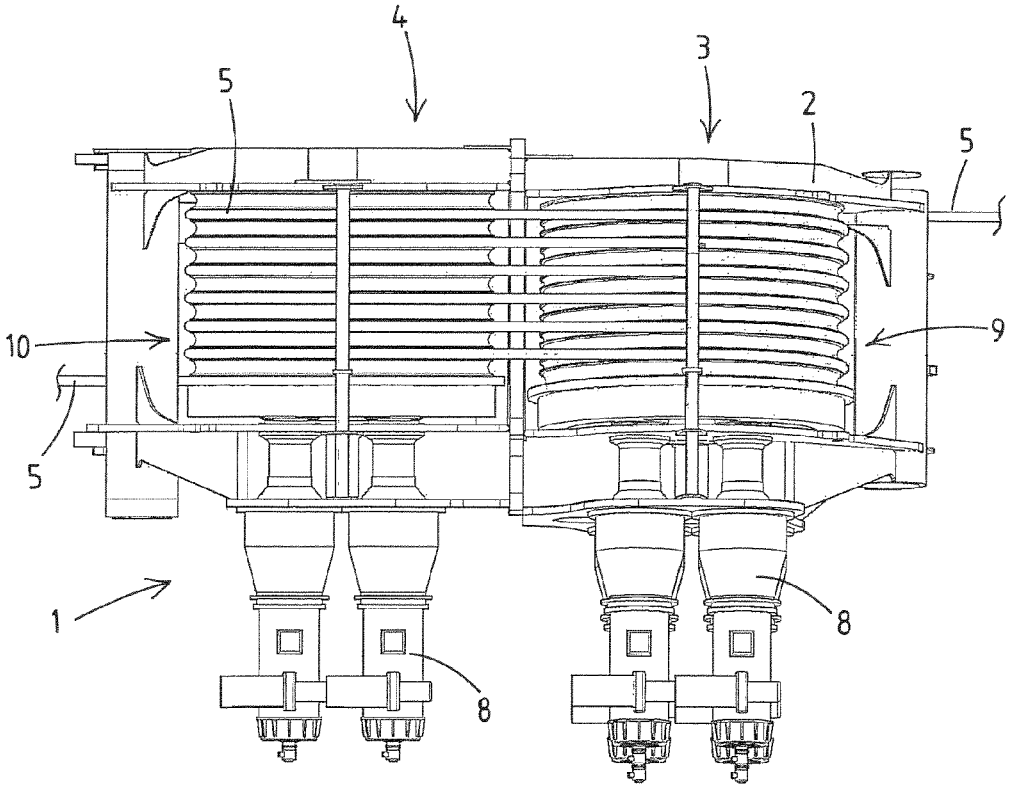
FIG. 4 shows a top view of the double drum traction winch of FIG. 1 supporting the first wire.
Figure 5:
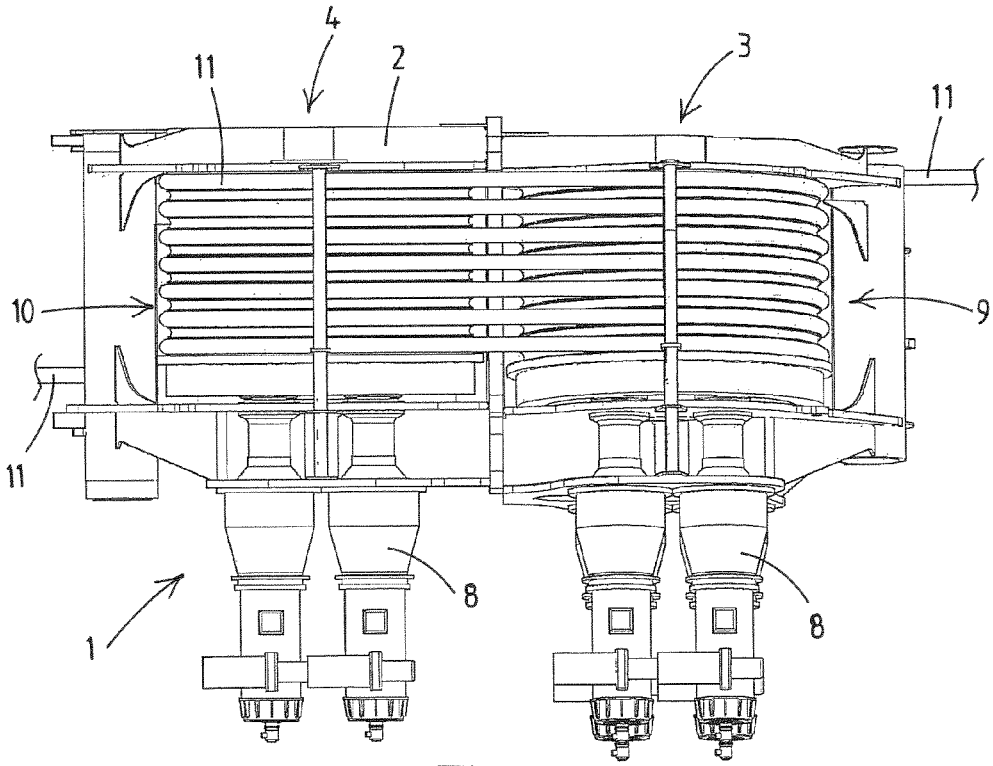
FIG. 5 shows a top view of the double drum traction winch of FIG. 1 supporting a second wire.
Figure 6:
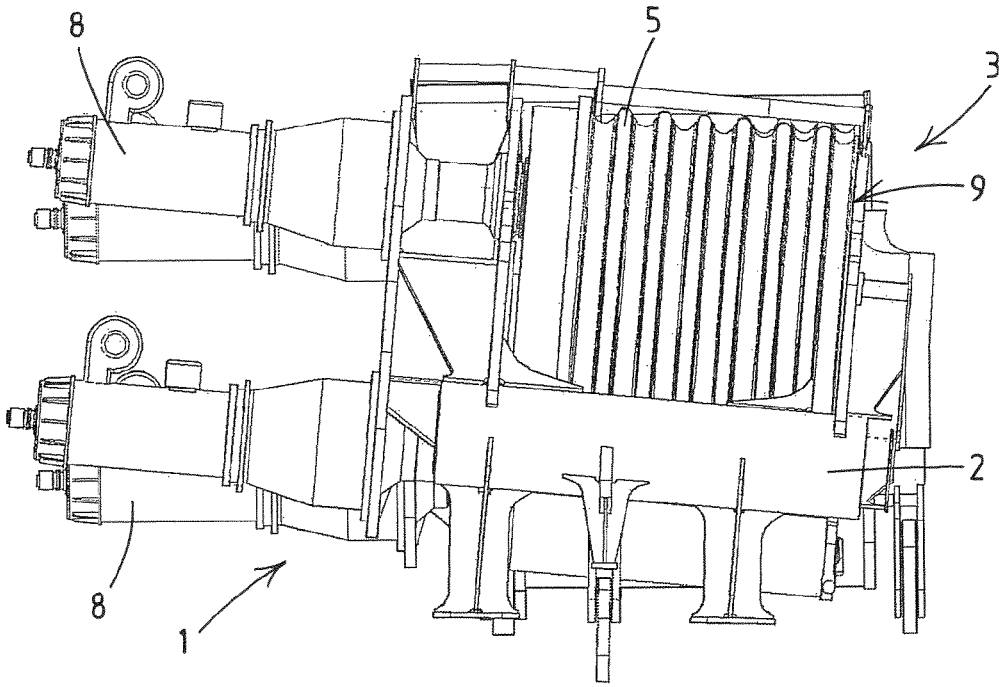
FIG. 6 shows a side view of the double drum traction winch of FIG. 1 supporting the first wire.
Figure 7:
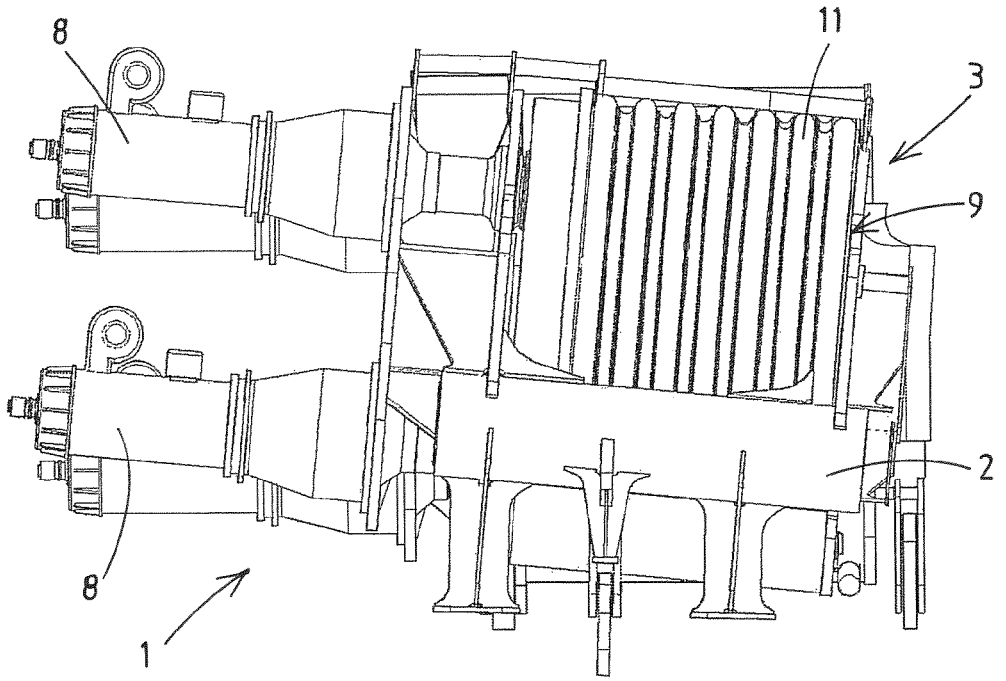
FIG. 7 shows a side view of the double drum traction winch of FIG. 1 supporting the second wire.

In FIG. 1, the double drum traction winch supports a first wire 5 in the narrow grooves 9N, 10N. FIG. 4 shows a top view and FIG. 6 shows a side view of the same winch supporting the wire 5. FIGS. 5 and 7 respectively show a top view and a side view of the double drum traction winch of FIG. 1 supporting a second wire 11, which has larger cross section than the wire 5, supported in the wide groves 9W, 10W.

Figure 3:
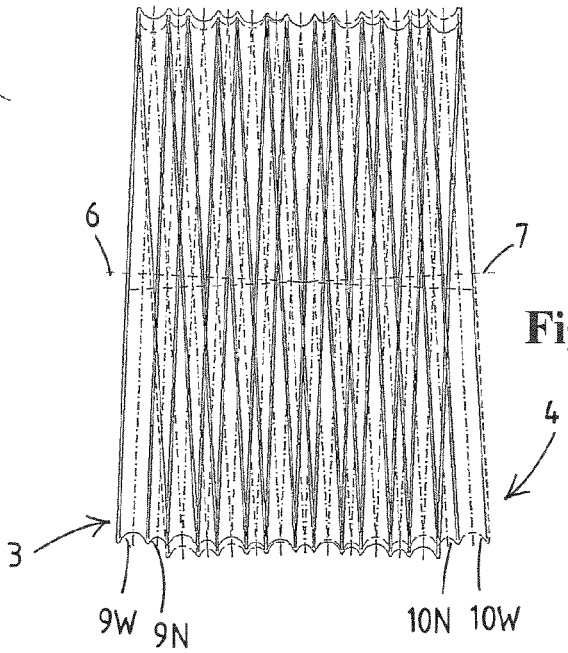
FIG. 3 shows an side view of the two drums of the double drum traction winch of FIG. 1.

FIG. 3 shows a side view of the drums of the exemplary traction winch without a wire. This view shows that the two drums are mounted in the frame of the traction winch such that the rotational axis 6 of the first drum 3 extends at an angle with the rotational axis 7 of the second drum 4. This feature also shows in FIGS. 6 and 7. When seen in top view, shown in FIGS. 4 and 5, the axes of the drums run parallel.

In the preferred embodiment shown, the rotational axis 6 of the first drum 3 is tilted relative to the rotational axis 7 of the second drum 4 such that a circumferential groove 10N on the second drum 4 guides the wire 5, wound about both drums, from a first guide groove 9N on the first drum 3 to a second guide groove 9N' on the first drum 3 (see FIG. 2).

In the preferred embodiment shown, the angle between the rotational axis 6 of the first drum 3 and the rotational axis 7 of the second drum 4 is such that the drum, more in particular a groove on the circumferential surface of that drum, guides the wire wound about both drums, over a distance along the rotational axis of the second drum which is essentially twice the distance between the centrelines of two adjacent grooves.

The double drum traction shown is provided with a storage drum, not shown, for storing the wire. From the storage drum, the wire is fed to traction winch. It enters a first groove on the low tension side of the traction winch. From there, the wire is passed several times around the pair of parallel traction drums, and from one groove to the other. The tension in the wire increases with each pass of a groove. At the end of the drum opposite the low tension side, the wire is fed from the traction winch to the load. The tension in the wire on this side of the drum is at a maximum, i.e. at a level for lifting the load.

For example, FIG. 5 shows a narrow wire which is fed from a storage drum (not shown) at the left to the traction winch 1. The wire is extends along the underside of the drums, and engages the traction winch at the first narrow groove of the first drum 3. This point of entry is shown at the lower left in FIG. 3. The wire 5 is subsequently guided via the groove to the top of the first drum, and extends from an exit point from the narrow groove in a direction towards the second drum 4. At the second drum, the wire enters the first narrow groove, shown at the top left in FIG. 3. This groove in turn guides the wire to the bottom of the second drum and to an exit point from which the wire returns to a second narrow groove on the first drum.

Since the rotational axes of both drums extend at an angle relative to each other, the exit point of the first narrow groove on the second drum 4 is more or less in line with an entry point of the second narrow groove on the first drum 3, and the exit point of the second narrow groove on the first drum 3 is more or less in line with the entry point of the second narrow groove of the second drum 4, etc. Thus, the wire is guided via one groove to the other until it reaches the last narrow groove on the second drum, from which it is guided along the underside of the two drums towards load on the right (not shown).

During use the first and second drum are driven by the drives 8, and a wire is fed by the traction winch form the storage drum on the left to the load on the right, or visa versa.

The traction drums hold the wire by friction and operate as the principal power means for drawing in or braking means for paying out the line. The storage drum upon which the low tension end of the line is spooled supplies the tension required to maintain the frictional forces between the wire and the traction drums.

Because the exit point at which the wire leaves a groove on one drum is located more or less directly across the entry point of the next groove on the opposite drum, the wire is fed from a groove on the one drum into a groove on the opposite drum more or less perpendicular to the rotational axes of the drums. This limits torsional forces inside the wire and reduces slip of the wire relative to the drum and therefore reduces wear of the wire.

A traction winch according to the invention is preferably provided with one or more guiding systems for guiding a wire from the storage drum to the traction winch and/or from the traction winch towards the load. Guide systems and storage drums as such are known from the art and are therefore not extensively elaborated upon here.

In a preferred embodiment, the traction winch is provided with a storage drum used for feeding both the wire for cooperating with the first set of grooves and the wire for cooperating with the second set of grooves. When changing the wires, the wire stored on the storage drum is fed to a storage reel. The other wire is subsequently fed from a storage reel onto the storage drum, and from the storage drum to the traction winch and elliptically reeved about the two drums and into the appropriate set of grooves. The storage drum is provided with either the wire for cooperating with the first set of grooves or with the wire for cooperating with the second set of grooves.

In a further preferred embodiment according to the invention, the traction winch is provided with a first and a second storage drum, one for storing the first wire and one for strong the second wire. Preferably, both storage drums are located in a fixed position relative to the traction winch, and one or more guide systems are provided for guiding the wires to the traction winch. In one embodiment, the storage drums are each provided with a guide system which guides the respective wire to the appropriate set of grooves. Alternatively, one guide system is provided which can be adjusted for guiding either the wire from the first storage drum or from the second storage drum to the traction winch.

In a further alternative embodiment, the storage drums are movable with respect to the traction winch between a feeding location and a storage location. In the feeding location the wire can be guided from the storage drum to the traction winch. While the storage drum feeding the wire to the traction winch is mounted in the feeding location, the storage drum holding the wire not being used is located in its storage location. For replacing the wires, the wire used is fully stored on its storage drum, which is subsequently moved into its storage location. The other storage drum is moved from its storage location into the feeding location, after which it is fed to the traction winch and elliptically reeved about the two drums.

In a preferred embodiment of a traction winch according to the invention, the diameter of the drums increases along the rotational axis.

During use, the tensional load in a wire increases along the circumferential surface of the drums. Thus, the tensional load in the wire is for example 15 Mt when entering the first groove, and 300 Mt ton when exiting the last groove. The increase in tensional load causes stretching of the wire. It is noted that that the increase of the wire length when loaded is especially pronounced in synthetic fibre wires. To prevent the elongation of the wire causing slippage of the wire along the circumferential surface of the drums, which increases wear of the wire and may even damage the wire and/or the surface of the drum, the diameter of the drum is increased along the rotational axis with each groove, to cope with the elongation of the wire.

With such a traction winch the diameter of the drum increases with a first factor for each consecutive groove of the first set and with a second factor for each consecutive groove of the second set. Thus the first set of grooves is adapted to cooperate with the elongation properties of a first wire, and the second set of grooves is adapted to cooperate with the elongation properties of a second wire. More in particular, the drums are adapted for coping with the difference in length of the respective first and second wire caused by the increase of tensional load in the respective wire with each groove.

Figure 8:
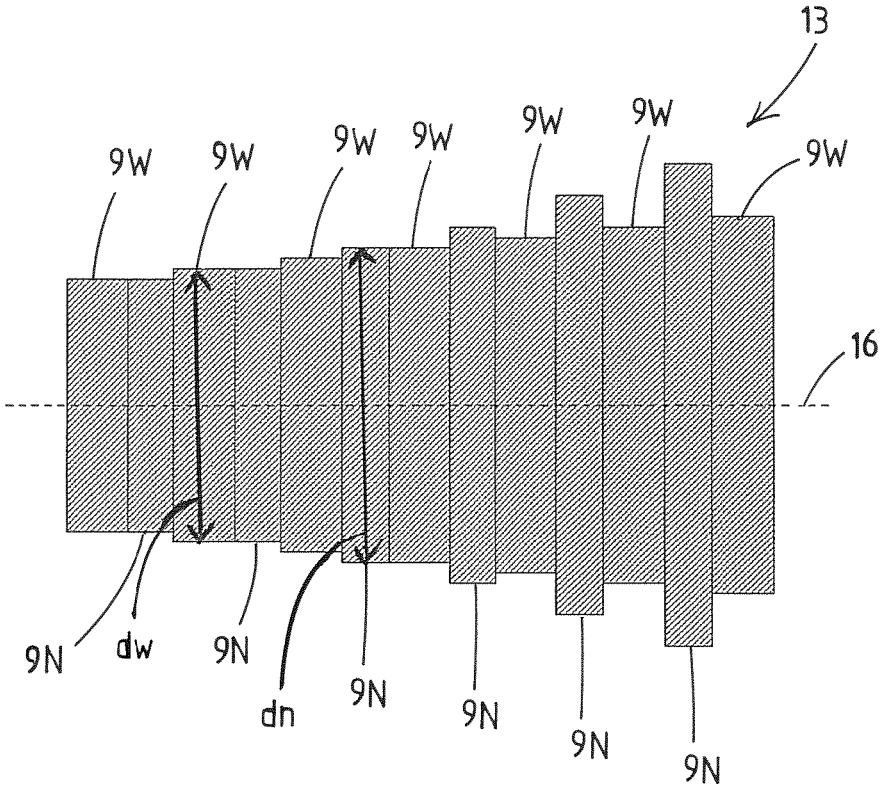
FIG. 8 shows a highly schematic side view in cross section of a drum for use in a traction winch according to the invention.

FIG. 8 shows a highly schematic side view in cross section of a drum 13, in which the increase in diameter with each groove is deliberately exaggerated for explanatory purposes. It is clear form the figure that the drum is provided with a first set of narrow grooves 19N and a second set of wide grooves 19W (the concave shape of the surface of each groove is not depicted). Furthermore, FIG. 8 clearly shows the increase in distance between the surface of the subsequent grooves and the rotational axis 16 of the drum 13. In the example shown, the diameter do of the subsequent ring shaped narrow grooves increases linear, which would be typical for example for steel wires. The diameter dw of the subsequent ring shaped wider grooves increases non-linear. This is typical for example for synthetic wires. The increase in diameter depends on the material and construction of the wire to be supported by the grooves. Thus the diameter of the drum increases with a first factor for each consecutive groove of the first set, and with a second factor for each consecutive groove of the second set. Depending on the type of wire, the factor can for example be constant, linear or non linear. It is noticed that in practice, the increase in diameter is more moderate than depicted in FIG. 8.

The cross section of the grooves is designed for cooperating with a predetermined type of wire, or to a predetermined range of wires having more or less similar properties. For example a set of grooves designed for cooperating with a steel wire having a cross section of 10 cm, is in practice also capable of cooperating with a steel wire having a slightly larger or slightly smaller cross section, for example a cross section of 10.1 or 9.9 cm.

Preferably, the maximum number of grooves in each set is determined by the maximum tension allowed in the wire for cooperating with the particular set. In practice this will be the maximum tension minus a safety margin. Preferably, the grooves are evenly distributed along the traction drum, i.e. are evenly distributed relative to an imaginary plane perpendicular to the rotational axis of the drum and dividing the drum in two equal halves.

Preferably, the number of grooves of the first set is equal to the number of grooves of the second set. When the number of grooves of one set is less than the number of grooves of the second set, both sets are preferably evenly distributed relative to the imaginary plane perpendicular to the rotational axis of the drum and dividing the drum in two equal halves.

In a further preferred embodiment of a traction winch according to the invention, the grooves of the first set are provided with a first cross section, for example a V-shaped cross section, and the grooves of the second set are provided with a second cross section, for example a U-shaped cross section, of which the form differs from the shape of the first cross section. The cross section of the first set is for example adapted for cooperation with a steel wire and the cross section of the second set is for example adapted for cooperation with a synthetic wire.

Preferably, the grooves of the second set have a width which is at least twice the width of the grooves of the first set. It is noted that for synthetic rope to be capable of handling the high tension involved in mooring and towing applications, the rope diameter must be quite large compared to steel wires.

The double drum traction winch and the one or more storage drums are for example mounted on a deck of a vessel, for example a ship, semi submersible or other floating structure, or on a support structure which is mounted to the vessel.

A drum traction winch according to the invention allows for flexible deployment in combination with low running costs. According to the invention the same winch can for example be used for lowering a structure in shallow water and for abandon and retrievement of a pipe in deep waters, using a steel wire with a small cross section in the first situation and using a synthetic wire with a large cross section in the second situation. Of the two wires, the type of wire most suitable for the specific task at hand can be used while there is no need for replacing the traction winch.

The invention furthermore provides a double drum traction winch of which the grooves of the first set are similar shaped to the grooves of the second set. The traction winch differs from the prior art in that the angle between the rotational axis of the first drum and the rotational axis of the second drum is such that the second drum guides a wire which is wound about both drums in a direction parallel to the rotational axis of the first drum over a distance which is essentially twice the distance between the centrelines of two adjacent grooves. The total number of grooves, i.e. of the combined sets, is thus about twice the number of grooves necessary to obtain the desired tension in a wire fit for use with the grooves. The traction winch can thus be used with two similar wires, more particular, with two similar wires which are wound about the drum parallel to each other.

Thus the traction winch can be used with a single wire for lifting lighter loads, and with an additional similar wire, i.e. two wires, for lifting heavy loads. By using double wires for lifting heavy loads and only a single wire for lifting lighter loads, overall wear in the wires is reduced.

Furthermore, wires with a smaller cross section are more flexible than wires with a large cross section. Using a traction winch with two wires having a small cross section in stead of with a single wire having a large cross section, allows for using pulleys with guide wheels having a small diameter, as well as for using a traction winch having drums with a relative small diameter. Thus the overall design of the traction winch and the wire guide system can be compact.

A double drum traction winch using two wires is preferably used in combination with a load equalising system, to ensure that the load is equally supported by both wires. Such a load equalising system is for example disclosed in patent publication NL2004801 filed in name of the applicant.

The invention claimed is:

1. Double drum traction winch comprising a frame supporting a first and second rotatable drum such that a first wire or a second wire can be wound about the two drums, further comprising at least one drive for rotating both drums about their respective rotational axis, wherein a circumferential surface of each drum is provided with parallel circumferential grooves perpendicular to the rotational axis of the drum for engaging the first wire or the second wire which is wound about both drums, wherein the parallel circumferential grooves of each drum are subdivided in a first set of multiple parallel circumferential grooves designed for guiding the first wire and a second set of multiple parallel circumferential grooves designed for guiding the second wire, and wherein the rotational axis of the first drum is tilted relative to the rotational axis of the second drum such that a circumferential groove of the first set of multiple circumferential grooves on the second drum guides the first wire wound about both drums from a first guide groove of the first set of multiple circumferential grooves on the first drum to a second guide groove of the first set of multiple circumferential grooves on the first drum and a circumferential groove of the second set of multiple circumferential grooves on the second drum guides the second wire wound about both drums from a first guide groove of the second set of multiple circumferential grooves on the first drum to a second guide groove of the second set of multiple circumferential grooves on the first drum, wherein the grooves of the first set of multiple parallel circumferential grooves alternate with the grooves of the second set of multiple parallel circumferential grooves such that the circumferential surface of each drum is provided with multiple parallel circumferential grooves of both the first set and the second set, and wherein, for each drum, multiple parallel circumferential grooves of the first set of multiple parallel circumferential grooves are each interpositioned between two grooves of the second set of multiple parallel circumferential grooves, such that the traction winch is designed for cooperating with the first wire in the first set of multiple parallel circumferential grooves or with the second wire in the second set of multiple parallel circumferential grooves, and wherein the first wire differs from the second wire in type of material and/or cross section and/or maximum tensile strength.

2. Double drum traction winch according to claim 1, wherein an angle between the rotational axis of the first drum and the rotational axis of the second drum is such that the second drum guides the first or the second wire which is wound about both drums in a direction parallel to the rotational axis of the first drum over a distance which is essentially twice the distance between the centrelines of two adjacent grooves.

3. Double drum traction winch according to claim 1, wherein the parallel circumferential grooves of the second set of multiple parallel circumferential grooves are wider than the parallel circumferential grooves of the first set of multiple parallel circumferential grooves such that the circumferential surface of each drum is provided with multiple narrow grooves which are each interpositioned inbetween two wide grooves.

4. Double drum traction winch according to claim 1, wherein for each drum the diameter of the drum increases along the rotational axis such that each consecutive groove of the first set of multiple parallel circumferential grooves increases with a first factor, and with each consecutive groove of the second set of multiple parallel circumferential grooves the diameter of the drum increases with a second factor, for coping with the increase in length of the first and second wire during use, caused by elongation due to the increase of tensional load in the wire with each groove.

5. Double drum traction winch according to claim 1, wherein the grooves of the first set of multiple parallel circumferential grooves are provided with a first cross section and the grooves of the second set of multiple parallel circumferential grooves are provided with a second cross section of which the shape and/or size differs from the shape and/or size of the first cross section.

6. Double drum traction winch according to claim 1, wherein the grooves of the second set of multiple parallel circumferential grooves have a width which is at least 1.25 times the width of the grooves of the first set of multiple parallel circumferential grooves.

7. Double drum traction winch according to claim 1, comprising a storage drum for holding the first wire for cooperating with the first set of multiple parallel circumferential grooves of the traction winch and for holding the second wire for cooperating with the second set of multiple parallel circumferential grooves of the traction winch, further comprising a guide system for guiding the first and second wire stored on the storage drum to respectively the first and second set of multiple parallel circumferential grooves of the traction winch.

8. Double drum traction winch according to claim 1, comprising a first storage drum for holding the first wire for cooperating with the first set of multiple parallel circumferential grooves of the traction winch and a first guiding system for feeding the first wire to the first set of multiple parallel circumferential grooves of the traction winch, and comprising a second storage drum for holding the second wire for cooperating with the second set of multiple parallel circumferential grooves of the traction winch and a second guiding system for feeding the second wire to the second set of multiple parallel circumferential grooves of the traction winch.

9. Double drum traction winch according to claim 8, wherein the first and second storage drums are both movable relative to the traction winch between a feeding location for feeding the first and second wire respectively to the traction winch and a storage location at a distance from the feeding location.

10. Double drum traction winch according to claim 9, wherein one feeding location is provided for use with both the first and the second storage drum.

11. Vessel provided with a double drum traction winch according to claim 1.

12. Method for using a double drum traction winch according to claim 1, comprising the steps of:

providing a first storage drum with the first wire for cooperating with the first set of multiple parallel grooves of the traction winch;

guiding the first wire from the first storage drum to the traction winch, winding the first wire about the two traction drums and inserting the first wire into the grooves of the first set of multiple parallel grooves;

guiding the first wire from the traction winch to a first load, and connecting the first wire with the first load;

lifting and/or lowering the first load using the traction winch and the first wire;

disconnecting the first wire form the first load and winding the first wire on the first storage drum, thus removing it from the traction winch;

providing a second storage drum with a second wire for cooperating with the second set of multiple parallel grooves of the traction winch;

guiding the second wire from the second storage drum to the traction winch, winding the second wire about the two traction drums and inserting the second wire into the grooves of the second set of multiple parallel grooves;

guiding the second wire from the traction winch to a second load, and connecting the second wire with the second load;

lifting and/or lowering the second load using the traction winch and the second wire.

* * * * *